US007006071B2

(12) United States Patent
Bu

(10) Patent No.: US 7,006,071 B2
(45) Date of Patent: Feb. 28, 2006

(54) DRIVING DEVICE

(75) Inventor: Lin-Kai Bu, Tainan (TW)

(73) Assignee: Himax Technologies, Inc., Tainan County (TW)

( * ) Notice: Subject to any disclaimer, the term of this patent is extended or adjusted under 35 U.S.C. 154(b) by 288 days.

(21) Appl. No.: 10/328,526

(22) Filed: Dec. 24, 2002

(65) Prior Publication Data

US 2003/0117360 A1 Jun. 26, 2003

Related U.S. Application Data

(63) Continuation-in-part of application No. 10/064,207, filed on Jun. 21, 2002.

(30) Foreign Application Priority Data

Dec. 25, 2001 (TW) ..... 090132259

(51) Int. Cl.
*G09G 3/36* (2006.01)

(52) U.S. Cl. ..... 345/100; 345/98

(58) Field of Classification Search ..... 345/87–100
See application file for complete search history.

(56) References Cited

U.S. PATENT DOCUMENTS 5,357,290 A * 10/1994 Horibe ..... 345/100
6,049,321 A * 4/2000 Sasaki ..... 345/100
6,157,358 A * 12/2000 Nakajima et al. ..... 345/98
6,166,725 A * 12/2000 Isami et al. ..... 345/100
6,304,241 B1 * 10/2001 Udo et al. ..... 345/100
6,424,328 B1 * 7/2002 Ino et al. ..... 345/100
6,747,624 B1 * 6/2004 Udo et al. ..... 345/89
6,784,866 B1 * 8/2004 Udo et al. ..... 345/100
2003/0234757 A1 * 12/2003 Bu ..... 345/90
2003/0234758 A1 * 12/2003 Bu et al. ..... 345/90

* cited by examiner

*Primary Examiner*—Bipin Shalwala
*Assistant Examiner*—David L. Lewis
(74) *Attorney, Agent, or Firm*—Thomas, Kayden, Horstemeyer & Risley

(57) ABSTRACT

A serial driving device for driving a passive module according to a number of digital pixel data is provided. The serial driving device includes a digital-to-analog converting unit, an analog buffer, a shift register, and an output buffer unit. The digital-to-analog converting unit is used for outputting a number of analog pixel data in series according to the digital pixel data. The pixel data output from the digital-to-analog converting unit is then processed by the analog buffer, the shift register, and the output buffer. The output buffer unit includes a number of driving sub-units for receiving the analog pixel data from the analog buffer in parallel. Each driving sub-units includes an output buffer, a primary switch, and a secondary switch. The primary switch is first turned on to drive the output terminal of the driving sub-unit toward an output voltage corresponding to the analog pixel data received by the driving sub-unit, and if the analog pixel data received by the driving sub-units are corresponding to the same gray level, the secondary switch is then turned on to drive the output terminal of the driving sub-units toward an average voltage.

14 Claims, 4 Drawing Sheets

DRIVING DEVICE

This application is a Continuation-in-Part of U.S. patent application Ser. No. 10/064,207, filed Jun. 21, 2002, titled "Method and related apparatus for driving an LCD monitor" by "Lin-Kai Bu" et al., and incorporates by reference Taiwan application Serial No. 090132259, filed Dec. 25, 2001.

BACKGROUND OF THE INVENTION

1. Field of the Invention

The present invention relates to a driving device, and more particularly, the present invention relates to a driving device for a passive module.

2. Description of the Related Art

A driving device is needed to drive a passive module. For example, the liquid crystal display (LCD) panel needs a driving device with high precision. The LCD panel has a pixel array. Taking the LCD panel with resolution of 1024×768 as an example. The LCD panel has 768 rows and each row has 1024×3 pixels with red, blue, and green colors. The pixels are controlled by a number of data lines and scan lines, and pixels are scanned sequentially by enabling the corresponding scan line. Pixel data transmitted by the data line determine the luminous of the corresponding pixels in the scanned row. A frame of image is displayed after 768 rows of pixels are scanned.

FIG. 1 is a block diagram of the conventional parallel driving device of the passive module. The passive module 160 can be a LCD panel, such as the thin film transistor (TFT) LCD panel or the liquid crystal on silicon (LCOS) panel. When displaying one row of pixels, 1024×3 digital pixel data D are input into a data buffer 120 of the passive module 160. The shift register 110 sequentially turns on each of the buffering units (not shown in FIG. 1) of the data buffer 120, so as to allow each pixel data to be latched in sequence into the corresponding buffering unit. The data buffer 120 includes at least 1024×3 buffer units. The shift register 110 can turn on or off the buffer units, so as to determine which buffer units are enabled to store the pixel data. If four buffer units, such as the first buffer unit to the fourth buffer unit, are turned on simultaneously, the corresponding pixel data D are input to the turned-on buffer units. Afterward, the shift register 110 will turn on the next four buffer units, such as the 5th buffer unit to the 8th buffer unit, to store the corresponding pixel data. All pixel data corresponding to one row of pixels are stored in the data buffer 120 after the turning on and off procedure of the shift register 110 is performed for 256×3 times (1024×3/4=256×3).

Then the pixel data is fed from the data buffer 120 to the voltage level converter 130 in parallel, so as to adjust the voltage level of the pixel data D. Then, a digital-to-analog converter 140 converts the adjusted pixel data D into an analog pixel data in parallel. Finally, the 1024×3 analog pixel data are input to the passive module 160 via the output buffer unit 150 in parallel.

In the conventional parallel driving device, since there are 1024×3 pixels for each row, the data buffer 120, the voltage level converter 130, and the digital-to-analog converter 140 each should be implemented with 1024×3 process units, so as to respectively process the pixel data for each of the pixels in parallel. Due to the increased integration, the hardware size is increased, the yield of production is reduced and the fabrication cost is increased.

Besides, the output buffer unit 150 can be implemented by a number of operational amplifiers, which function as an output buffer. The analog pixel data which the output buffer unit 150 received is amplified by the operational amplifiers. The amplified analog data is then applied to data lines of the passive module 160. However, the offset of the operational amplifiers are not equal to each other. Thus, even when the analog data with the same voltage corresponding to the same gray level is input to the operational amplifiers, the output voltages of these operational amplifiers are different. Therefore, it is necessary to provide a way to solve the problem caused from the different offset of the operational amplifiers.

SUMMARY OF THE INVENTION

It is therefore an objective of the present invention to provide a driving device, so as to reduce the size of the product. Besides, a way for resolving the problem caused from the different offset of the operational amplifiers is provided.

In accordance with the foregoing objective of the present invention, the invention provides a driving device for driving a passive module according to a number of digital pixel data. The driving device includes a digital-to-analog converting unit, an analog buffer, a shift register, and an output buffer unit. The digital-to-analog converting unit is used for outputting a number of analog pixel data in series according to the digital pixel data. The digital-to-analog converting unit includes a data buffer, a voltage level converter, and a digital-to-analog converter. The data buffer is used for buffering the digital pixel data and outputting the digital pixel data. The voltage level converter is coupled to the data buffer, for adjusting the voltage level of the digital pixel data output from the data buffer and outputting an adjusted digital pixel data. And, the digital-to-analog converter is coupled to the voltage level converter, for converting the adjusted digital pixel data into a number of analog pixel data, and outputting the analog pixel data in series. The analog buffer is coupled to the digital-to-analog converting unit, for sampling and temporarily storing the analog pixel data and for outputting the stored analog pixel data in parallel. The shift register is coupled to the analog buffer, for controlling the analog buffer to storing the analog pixel data. The output buffer unit includes a number of driving sub-units for receiving the analog pixel data from the analog buffer in parallel. The driving sub-units are labeled as 1-st, 2-nd . . . i-th . . . j-th . . . N-th driving sub-units, N, i and j are integers, $i, j \leqq N$, $i \neq j$. The i-th driving sub-unit includes an i-th output buffer, an i-th primary switch, and an i-th secondary switch. The i-th primary switch is connected between an i-th output terminal of the i-th output buffer and an i-th output terminal of the i-th driving sub-unit, and the i-th output terminal of the i-th output buffer is electrically connected to the i-th output terminal of the i-th driving sub-unit when the i-th primary switch is turned on. The i-th secondary switch is connected between the i-th output terminal of the i-th driving sub-unit and a j-th output terminal of the j-th driving sub-unit. The i-th output terminal of the i-th driving unit is electrically connected to the j-th output terminal of the j-th driving sub-unit when the i-th secondary switch is turned on. The i-th primary switch is first turned on to drive the i-th output terminal of the i-th driving sub-unit toward a i-th output voltage corresponding to the analog pixel data received by the i-th driving sub-unit, and if the analog pixel data received by the i-th and j-th driving sub-units are corresponding to the same gray level, the i-th secondary switch is then turned on to drive the i-th and j-th output terminal of the i-th and j-th driving sub-units toward an average voltage. Signals output from the output buffer unit are input to the passive module.

Other objects, features, and advantages of the invention will become apparent from the following detailed description of the preferred but non-limiting embodiments. The following description is made with reference to the accompanying drawings.

BRIEF DESCRIPTION OF THE DRAWINGS

The invention can be more fully understood by reading the following detailed description of the preferred embodiment, with reference made to the accompanying drawings, wherein.

DETAILED DESCRIPTION OF THE INVENTION

The conventional driving device requires the high hardware size because the pixel data is processed in parallel. As a result, each of the data buffer, the voltage level converter, and the digital-to-analog converter needs to be implemented with a number of process units with at least the same number of the pixels in each row. In a driving device of the invention, a data buffer, a voltage level converter, and a digital-to-analog converter are separated from an analog buffer, a shift register, and a output buffer unit, and the process of converting the pixel data is performed in series.

Figure 1:
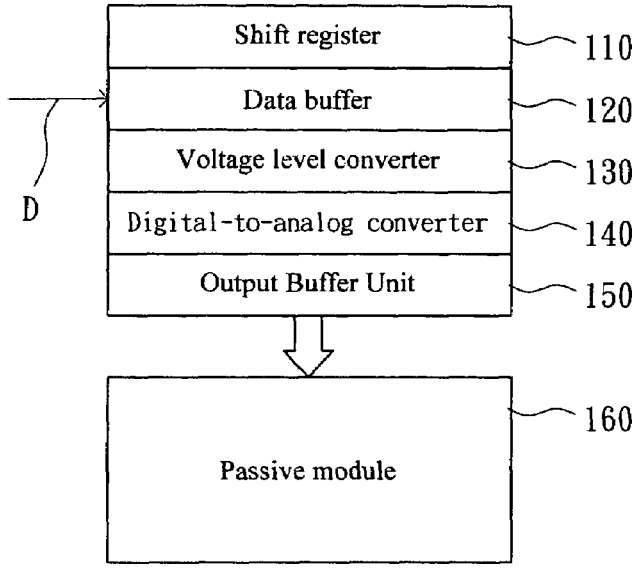
FIG. 1(PRIOR ART)
FIG. 1 is a block diagram of the conventional parallel driving device of a passive module.
Figure 2:
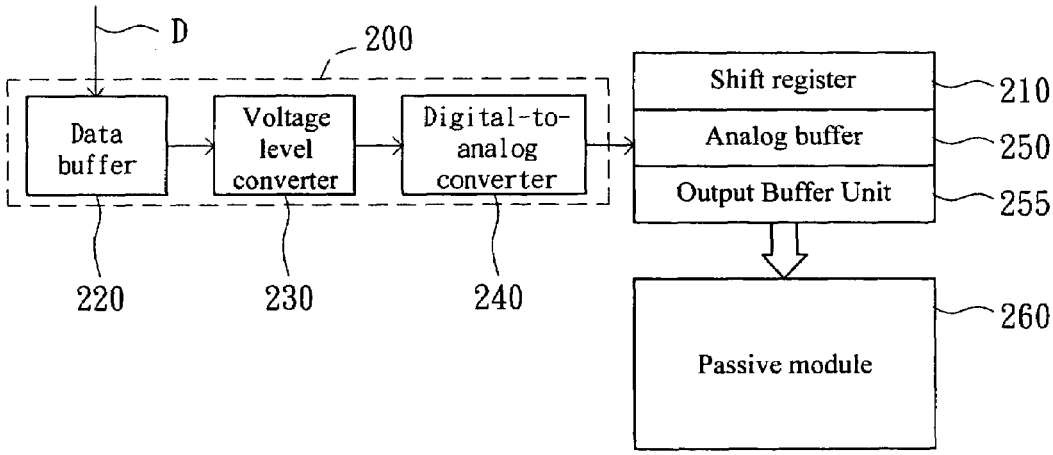
FIG. 2 is a block diagram of a serial driving device according to a preferred embodiment of the present invention.

FIG. 2 is a block diagram of the driving device according to a preferred embodiment of the present invention. The driving device includes a digital-to-analog converting unit 200, a shift register 210, and an analog buffer 250. The digital-to-analog converting unit 200 includes a data buffer 220, a voltage level converter 230, and a digital-to-analog converter 240. The difference between the conventional driving device and the driving device of the present invention is that the pixel data D is first processed by the data buffer 220, the voltage level converter 230, and the digital-to-analog converter 240, and is then fed to the analog buffer 250. The shift register 210, with the similar function as the shift register 110 of the conventional parallel driving device shown in FIG. 1, can allow the data output from the digital-to-analog converter 240 to be sequentially input to each of the analog buffer units of the analog buffer 250. Assume that the shift register 210 can sequentially turn on four analog buffer units of the analog buffer 250, then the data buffer 220, the voltage level converter 230, and the digital-to-analog converter 240 need to be implemented with only four process units, and the processed pixel data are output in series. After the analog buffer 250 has sequentially received 256×3 sets of pixel data, each set including 4 pixel data, the pixel data of one row can then be obtained. After the analog buffer 250 feeds the pixel data for the entire row to the output buffer unit 250, then the output buffer unit 150 can feed the 1024×3 pixel data to the passive module 260 for displaying.

The detailed description about the driving device of the invention is as follows. The digital-to-analog converting unit 200 is used for outputting a number of analog pixel data in series according to the digital pixel data D. In the digital-to-analog converting unit 200, the data buffer 220 is used for buffering the digital pixel data and then outputting the digital pixel data; the voltage level converter 230 is coupled to the data buffer 220, and is used for adjusting the voltage level of the digital pixel data output from the data buffer 220 and then outputting an adjusted digital pixel data; the digital-to-analog converter 240 is coupled to the voltage level converter 230, and is used for converting the adjusted digital pixel data into a number of analog pixel data, and then outputting the analog pixel data in series.

The analog buffer 250 is coupled to the digital-to-analog converting unit 200, and the analog buffer 250 is used for sampling and temporarily storing the analog pixel data in sequence and then outputting the stored analog pixel data in parallel. The shift register 210 is coupled to the analog buffer 250, and the shift register 210 is used for controlling the analog buffer 250 to store the analog pixel data. The output buffer unit includes a number of driving sub-units for receiving the analog pixel data from the analog buffer in parallel. Signals outputted from the output buffer unit 250 are input to the passive module 260.

Since the data buffer 220, the voltage level converter 230, and the digital-to-analog converter 240 have processed the pixel data D in series, the size for the data buffer 220, the voltage level converter 230, and the digital-to-analog converter 240 can be greatly reduced to 1/256 (4/1024=1/256) of that in the conventional driving device shown in FIG. 1.

It should be noted that the design parameters used in the preferred embodiment are only examples of the present invention, and are not restricted thereto. Any skilled person in the art can modify the design parameters, for example, the shift register 210 can sequentially turn on M analog buffer units of the analog buffer 250, and the data buffer 220, the voltage level converter 230, and the digital-to-analog converter 240 could to be implemented with M process units.

Besides, in order to solve the problem caused from the different offset of the operational amplifiers, the output buffer unit 250 is designed as follows. The output buffer unit 250 includes a number of driving sub-units for receiving the analog pixel data from the analog buffer 250 in parallel. The driving sub-units are labeled as 1-st, 2-nd . . . i-th . . . j-th . . . N-th driving sub-units. N, i and j are integers, $i, j \leqq N$, and $i \neq j$. Taking the i-th driving sub-unit as an example, the i-th driving sub-unit includes an i-th output buffer, an i-th primary switch, and an i-th secondary switch. The i-th primary switch is connected between an i-th output terminal of the i-th output buffer and an i-th output terminal of the i-th driving sub-unit. The i-th output terminal of the i-th output buffer is electrically connected to the i-th output terminal of the i-th driving sub-unit when the i-th primary switch is turned on. The i-th secondary switch is connected between the i-th output terminal of the i-th driving sub-unit and a j-th output terminal of the j-th driving sub-unit. The i-th output terminal of the i-th driving unit being electrically connected to the j-th output terminal of the j-th driving sub-unit when the i-th secondary switch is turned on. The i-th primary switch is first turned on to drive the i-th output terminal of the i-th driving sub-unit toward a i-th output voltage corresponding to the analog pixel data received by the i-th driving sub-unit. After that, if the analog pixel data received by the i-th and j-th driving sub-units are corresponding to the same gray level, the i-th secondary switch is then turned on to drive the i-th and j-th output terminal of the i-th and j-th driving sub-units toward an average voltage.

Figure 3:
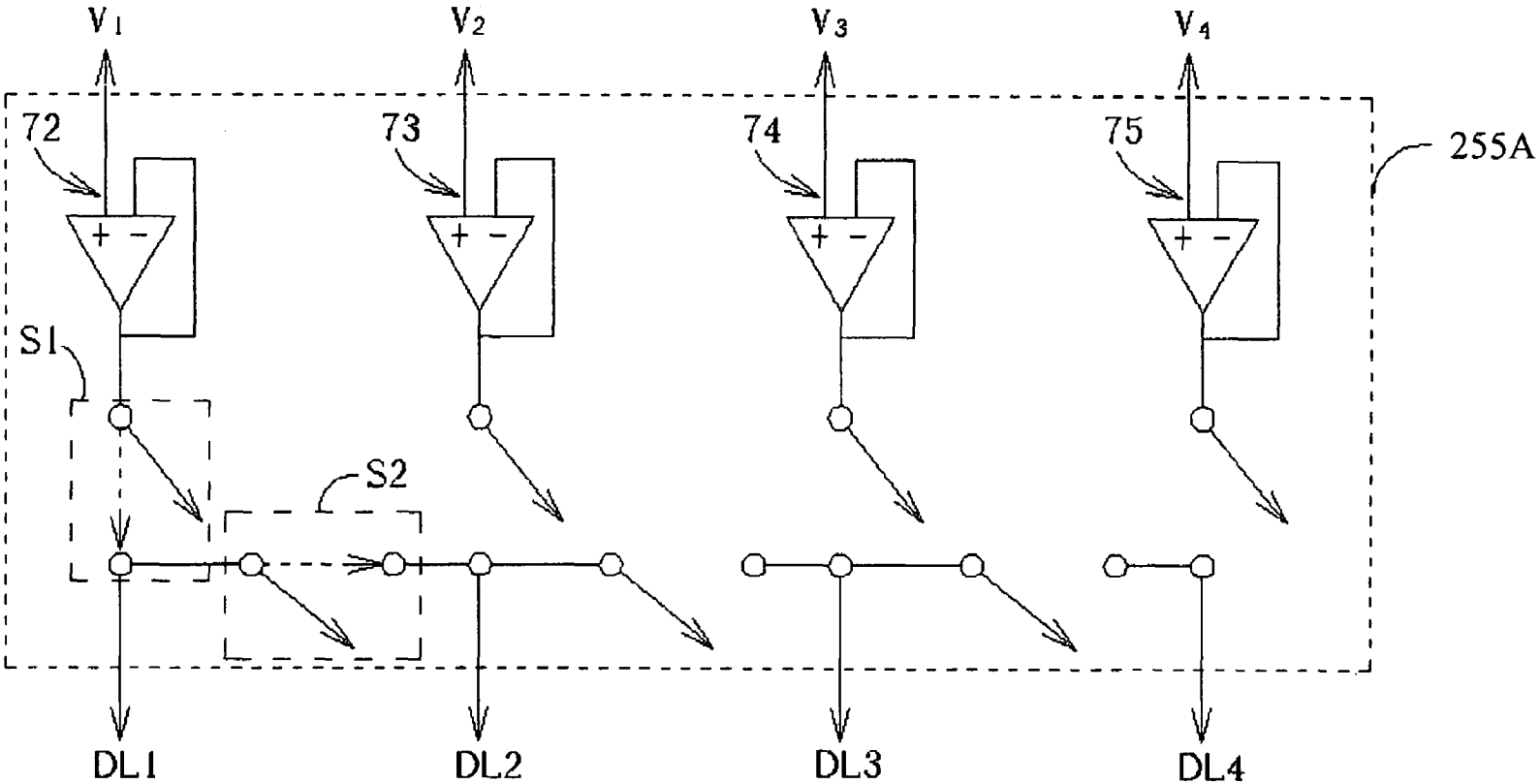
FIG. 3 is a schematic diagram of the output buffer unit according to the present invention.
Figure 4:
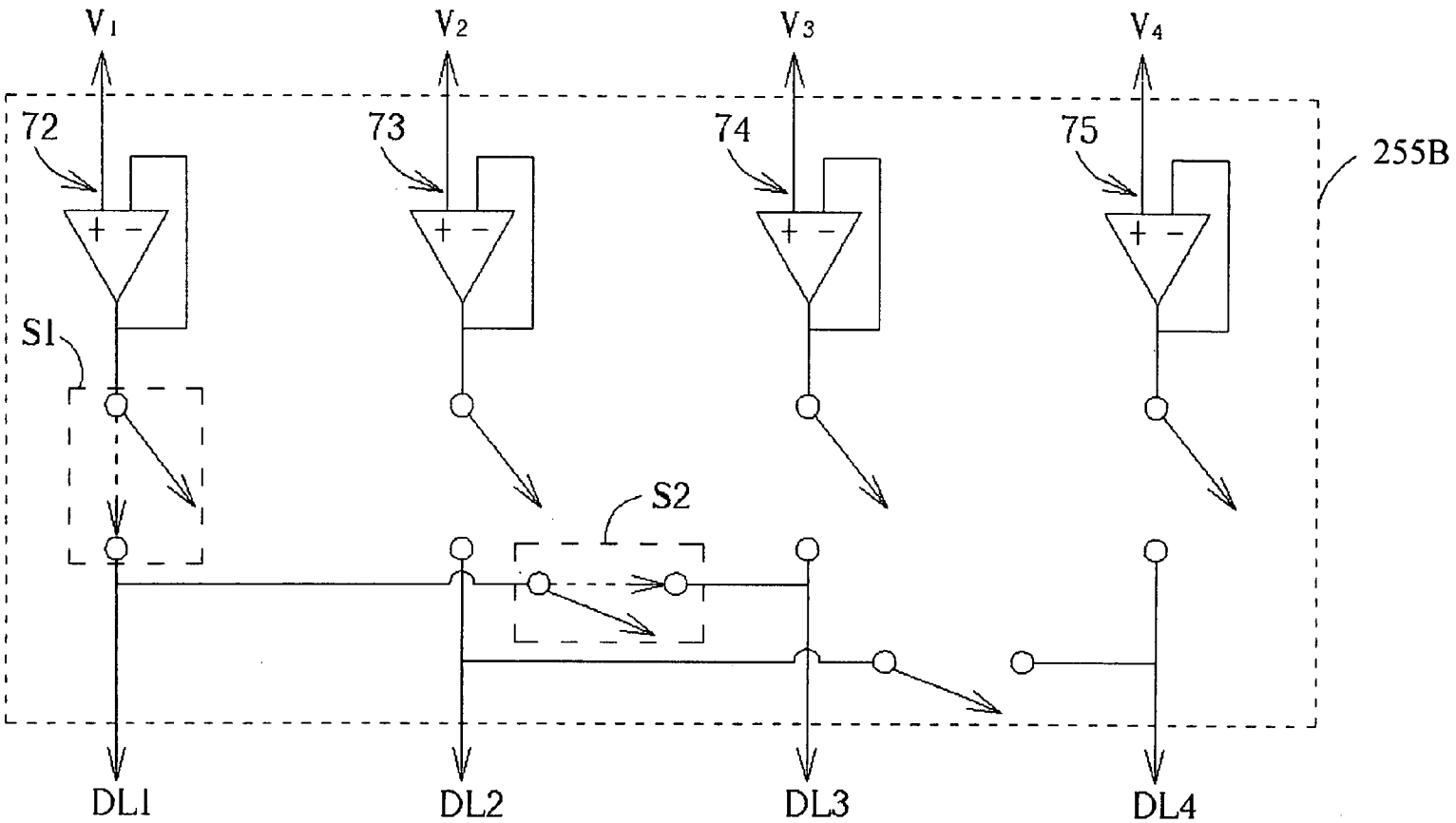
FIG. 4 is a schematic diagram of a output buffer unit according to the present invention.

As shown in FIG. 3, the value of j can be equal to the value of i+1 in the output buffer unit 250A when the passive module 260 is driven according to a line, or frame inversion method. As shown in FIG. 4, the value of j can be equal to the value of i+2 in the output buffer unit 250B when the passive module 260 is driven according to a dot inversion method, a two dot line inversion method, or a column inversion method. Besides, the output buffer is an operational amplifier.

Please refer to FIG. 3, which is a schematic diagram of the output buffer unit 250A according to the present invention. The output buffer unit 250A has a number of operational amplifiers 72, 73, 74, and 75 to function as output buffers, and a number of switches S1, S2 related to the operational amplifiers 72, 73, 74, and 75. Please note that only four operational amplifiers are drawn in FIG. 3 for simplicity, and the operational amplifiers 72, 73, 74, and 75 and switches S1 and S2 are used for driving corresponding pixels through data lines DL1, DL2, DL3, and DL4.

The operation of the output buffer unit 250A is described as follows. In the beginning, each switch S1 is first turned on to make the operational amplifiers 72, 73, 74, and 75 electrically connected to corresponding data lines DL1, DL2, DL3, and DL4. As mentioned before, each operational amplifier 72, 73, 74, and 75 has a unique offset respectively affecting the output voltage to deviate from the input voltage. In other words, if the pixels with regard to the operational amplifiers 72, and 73 are prepared to be driven by the same input voltage level, that is, V1 is equal to V2, the voltage levels of the data lines DL1, and DL2 are different owing to the respective offsets corresponding to the operational amplifiers 72, and 73. Then, all the switches S1 related to the operational amplifiers 72, 73, 74, and 75 are turned off simultaneously.

Next, if the operational amplifiers 72 and 73 prepare to drive corresponding pixels toward the same gray level through data lines DL1, and DL2, the switch S2 related to the operational amplifiers 72 and 73 is then turned on. Therefore, the voltage levels of the data lines DL1, and DL2 will quickly approach an average voltage from these two voltage levels. That is, the original offsets are averaged to generate the average voltage for the data lines DL1, and DL2. Similarly, if the operational amplifiers 73 and 74 prepare to drive corresponding pixels toward the same gray level through data lines DL2, and DL3, the switch S2 related to the operational amplifiers 73 and 74 is then turned on as well. Therefore, any adjacent pixels driven by the same input voltage will finally have the same gray level with the help of switch S2. To sum up, voltage at each data line DL1, DL2, DL3, or DL4 is first driven by a corresponding operational amplifier 72, 73, 74, or 75 after the switch S1 related to each operational amplifier 72, 73, 74, or 75 is turned on. Then, each switch S1 is turned off. In addition, the switch S2 is turned on when related adjacent pixels related to the switch S2 are prepared to have the same gray level. Finally, the voltage deviation between the adjacent data lines is eliminated by averaging the offsets generated by the corresponding operational amplifiers through the switch S2.

In FIG. 3, the output buffer unit 250A is applied on a LCD panel driven according to a line or frame inversion method. Because the pixels positioned in the same row will have the same polarity according to the line inversion method, the switch S2 is capable of averaging voltages with the same polarity at adjacent data lines such as data lines DL1, and DL2.

Please refer to FIG. 4, which is a schematic diagram of a output buffer unit 250B according to the present invention. The output buffer unit 250B is similar to the output buffer unit 250A. Only the arrangement of the switches S1, and S2 is different. As shown in FIG. 4, there is a switch S2 electrically connected to the operational amplifiers 72, 74, and another switch S2 is electrically connected to the operational amplifiers 73, 75. That is, the adjacent data lines such as DL1 and DL2 are not connected through the switch S2. When pixels are driven by a dot inversion method, a two dot line inversion method, or a column inversion method, adjacent pixels in the same row are driven by voltages with opposite polarities. That is, pixels connected to lines DL1, DL2, DL3, DL4 respectively have polarities such as "+" "−" "+" "−" or "−" "+" "−" "+". Therefore, the output buffer unit 250B uses switches S2 connected to adjacent operational amplifiers that have the same polarity for averaging above-mentioned offsets when corresponding pixels with the same polarity are driven to the identical gray level.

For example, if the pixels connected to the data lines DL1, and DL3 are going to have the same gray level, the switches S1 corresponding to operational amplifiers 72 and 74 are first turned on in the beginning. Because the offsets related to the operational amplifiers 72 and 74 are different, the voltages at the data lines DL1, and DL3 are different as well. Then, the switch S2 related to the lines DL1, and DL3 is turned on. Therefore, the voltage deviation between the lines DL1, and DL3 is eliminated by averaging the offsets generated by the corresponding operational amplifiers 72, and 74. It is noteworthy that the offsets generated from the operational amplifiers 72 and 74 are averaged to generate an average voltage at both lines DL1, and DL3. In other words, the lines DL1 and DL3 still have an averaged offset according to the present invention. But, the voltages at data lines DL1, and DL3 are equal after all.

In addition, if two adjacent pixels are not going to have the same gray level, the switch S2 related to the corresponding pixels is kept off without affecting the gray levels of the adjacent pixels. In FIG. 4, the switch S2 is connected to two data lines driven according to the same polarity and these two data lines is spaced by another data line driven according to an opposite polarity. That is, the output buffer unit 250B is applied on an LCD panel driven by a column inversion method, a dot inversion method, or a two dot line inversion.

Figure 5:
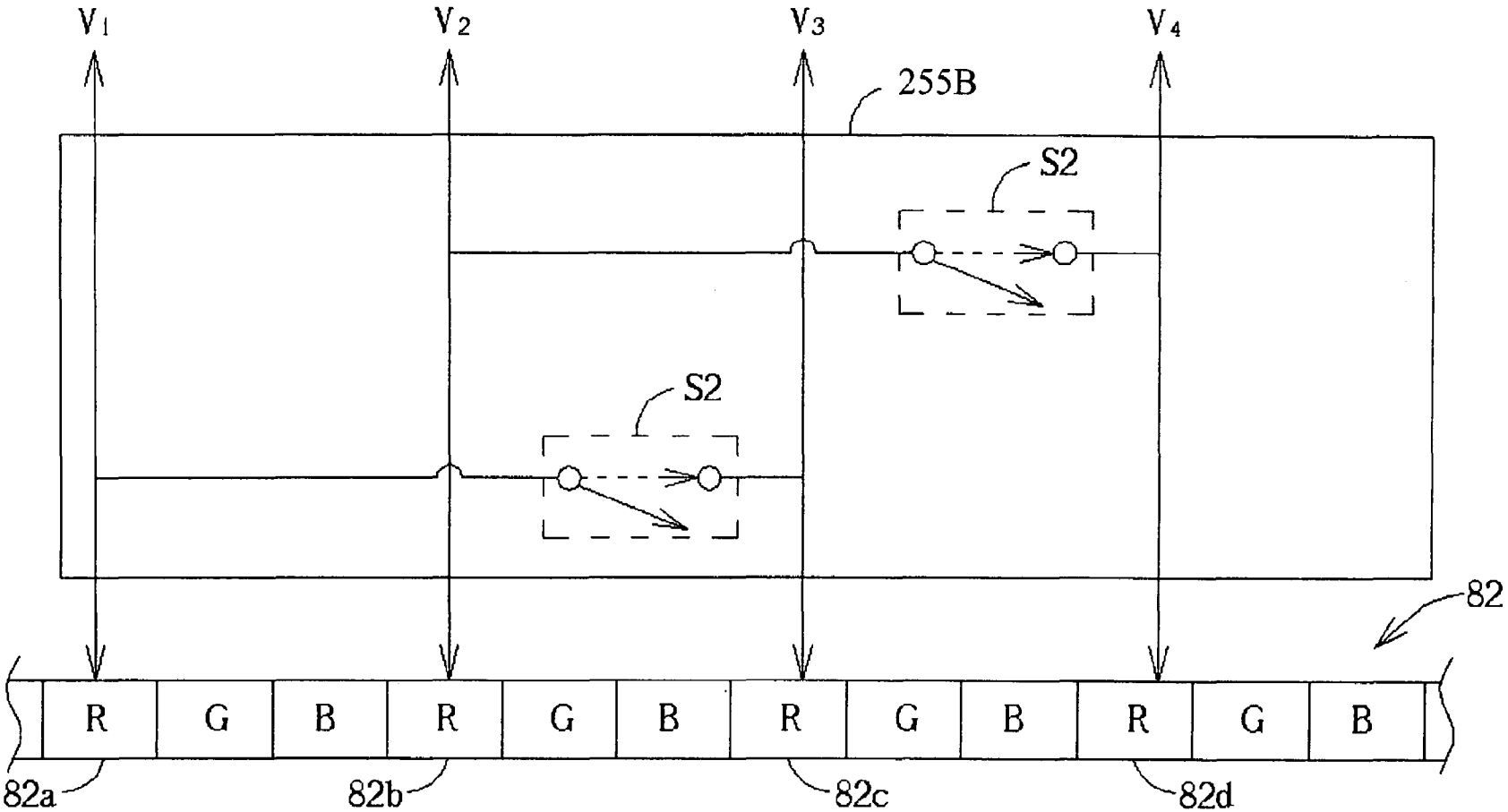
FIG. 5 is a simplified diagram of a connection between pixels and the output buffer unit shown in FIG. 4.

Please refer to FIG. 5, which is a simplified diagram of a connection between pixels 82 and the output buffer unit 250B shown in FIG. 4. A specific color is generated by mixing three monochromatic lights such as a red light, a green light, and a blue light respectively having different intensities. Therefore, pixels 82 located at the same row are individually responsible for providing a gray level with regard to the red light, the green light, or the blue light. As shown in FIG. 5, there are pixels 82 used for representing a color sequence "R G B R G B R G B R G B". When the pixels 82 are driven according to a dot inversion method, a two dot line inversion method, or a column inversion method, adjacent pixels 82 will have opposite polarities. For example, the pixels 82 are driven according to a polarity sequence "+−+−+−+−+−+−". Concerning the red light, the pixels 82*a* and 82*c* have the same polarity "+", and the pixels 82*b* and 82*d* have the same polarity "−". For the pixels 82*a*, 82*b*, 82*c*, and 82*d* with regard to the red light, one switch S2 is connected between the pixels 82*a* and 82*c* driven by the same polarity "+". In addition, another switch S2 is connected between the pixels 82*b* and 82*d*. Therefore, when the output buffer unit 250B is used for driving pixels with regard to one specific monochromatic light, a switch S2 is responsible for equaling voltages inputted into two adjacent pixels driven by the same polarity and driven to the same gray level. It is noteworthy that the above-mentioned driving method is also applied on driving pixels with regard to green light and blue light, and the repeated description is skipped for simplicity.

The output buffer unit 250A and 250B shown in FIG. 3 and FIG. 4 use switches S2 to perform the local voltage average operation. That is, the switch S2 is turned on only when two adjacent pixels related to the switch S2 are prepared to be driven by an identical voltage level. Users are only sensitive to gray level difference between adjacent pixels, but are not sensitive to the gray level of each pixel. Therefore, the objective of the output buffer unit 250A and 250B is to eliminate the gray level difference between adjacent pixels when the adjacent pixels are driven by the same voltage level. That is, switches S2 of the output buffer unit 250A and 250B for eliminating voltage deviations between two adjacent pixels are used only for achieving a uniform gray level.

As mentioned above, the output buffer unit 250A is applied on an LCD monitor driven by a line inversion method, and the output buffer unit 250B is applied on an LCD monitor driven by a column inversion method, a dot inversion method, or a two dot line inversion. Therefore, the operational amplifier circuit according to the present invention can be applied on an LCD monitor, which is driven according to a predetermined method, to solve the offset deviation problem.

In addition, the TFT LCD according to the present invention further comprises a XOR logic circuit or a comparator to determine whether the switch S2 is turned on or not. That is, the XOR logic circuit is used for comparing digital input driving data related two pixels to check whether the pixels are going to have the same gray level, and the comparator is used for comparing analog input driving data related to two pixels to check whether the pixels are going to have the same gray level. When the XOR logic circuit or the comparator acknowledges that two pixels are prepared to be driven toward the same gray level, the switch S2 related to the pixels will be turned on to eliminate the offset deviation. In other words, the TFT LCD has a detecting circuit such as a XOR logic circuit for digital driving data or a comparator for analog driving data to compare driving data with regard to two pixels. When these two pixels are going to have the same gray level, the switch S2 related to these two pixels is turned on according to a comparison result generated from the XOR logic circuit or the comparator. Furthermore, the present invention is capable of using operational transconductance amplifiers instead of the operational amplifiers to drive the pixels.

In conclusion, the foregoing preferred embodiment of the present invention has disclosed the driving device in a series arrangement, which can effectively reduce the volume of hardware, increase the yield of production, and reduce the fabrication cost. Besides, the problem caused from the different offset of the operational amplifiers can be solved.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A driving device for driving a passive module according to an input signal including a plurality of digital pixel data which are associated with a plurality of to-be-scanned pixels of the passive module, the driving device comprising:

a digital-to-analog converting unit for outputting a plurality of analog pixel data in series according to the input signal including the digital pixel data, the digital-to-analog converting unit comprising:

a data buffer for buffering the digital pixel data and outputting the digital pixel data;

a voltage level converter coupled to the data buffer, for adjusting the voltage level of the digital pixel data output from the data buffer and outputting an adjusted digital pixel data; and a digital-to-analog converter coupled to the voltage level converter, for converting the adjusted digital pixel data into a plurality of analog pixel data, and outputting the analog pixel data in series;

an analog buffer including a plurality of analog buffer units, each analog buffer unit coupled to the digital-to-analog converting unit for sampling and temporarily storing the analog pixel data in sequence and for outputting the stored analog pixel data in parallel;

a shift register coupled to the analog buffer, for controlling the analog buffer to store the analog pixel data; and an output buffer unit including a plurality of driving sub-units for receiving the analog pixel data from the analog buffer in parallel, wherein the driving sub-units are named as 1-st, 2-nd, . . . , i-th, . . . j-th, . . . N-th driving sub-units, N, i and j are integers, $i, j \leqq N$, $i \neq j$, and the i-th driving sub-unit comprises:

an i-th output buffer;

an i-th primary switch connected between an i-th output terminal of the i-th output buffer and an i-th output terminal of the i-th driving sub-unit, the i-th output terminal of the i-th output buffer being electrically connected to the i-th output terminal of the i-th driving sub-unit when the i-th primary switch is turned on; and an i-th secondary switch connected between the i-th output terminal of the i-th driving sub-unit and a j-th output terminal of the j-th driving sub-unit, the i-th output terminal of the i-th driving unit being electrically connected to the j-th output terminal of the j-th driving sub-unit when the i-th secondary switch is turned on;

wherein the i-th primary switch is first turned on to drive the i-th output terminal of the i-th driving sub-unit toward an i-th output voltage corresponding to the analog pixel data received by the i-th driving sub-unit, and if the analog pixel data received by the i-th and j-th driving sub-units are corresponding to a same gray level, the i-th secondary switch is then turned on to drive the i-th and j-th output terminal of the i-th and j-th driving sub-units toward an average voltage;

wherein signals outputted from the output buffer unit to coupled to the to-be-scanned pixels of the passive module.

2. The driving device as recited in claim 1, wherein the passive module comprises a liquid crystal display (LCD) panel.

3. The driving device as recited in claim 2, wherein the liquid crystal display panel comprises a thin film transistor (TFT) liquid crystal display panel.

4. The driving device as recited in claim 2, wherein the liquid crystal display panel comprises a liquid crystal on silicon (LCOS) panel.

5. The driving device as recited in claim 1, wherein j is equal to i+1 when the passive module is driven according to a line or frame inversion method.

6. The driving device as recited in claim 1, wherein j is equal to i+2 or i+6 when the passive module is driven according to a dot inversion method, a two dot line inversion method, or a column inversion method.

7. The driving device as recited in claim 1, wherein the i-th output buffer is an operational amplifier.

8. A driving device for driving a passive module according to an input signal including a plurality of digital pixel data which are associated with a plurality of to-be-scanned pixels of the passive module, the driving device comprising:

a digital-to-analog converting unit for outputting a plurality of analog pixel data in series according to the input signal including the digital pixel data:

an analog buffer including a plurality of analog buffer units, each analog buffer unit coupled to the digital-to-analog converting unit for temporarily storing the analog pixel data in sequence and for outputting the stored analog pixel data in parallel;

a shift register coupled to the analog buffer, for controlling the analog buffer to store the analog pixel data; and an output buffer unit including a plurality of driving sub-units for receiving the analog pixel data from the analog buffer in parallel, wherein the driving sub-units are sequentially named as 1 st to N-th driving sub-units, N, i and j are integers, i, j≦N, i≠j, and the i-th driving sub-unit comprises:

an i-th output buffer;

an i-th primary switch coupled between an i-th output terminal of the i-th output buffer and an i-th output terminal of the i-th driving sub-unit; and an i-th secondary switch coupled between the i-th output terminal of the i-th driving sub-unit and a j-th output terminal of the j-th driving sub-unit;

wherein the i-th primary switch is first turned on to drive the i-th output terminal of the i-th driving sub-unit toward an i-th output voltage corresponding to the analog pixel data received by the i-th driving sub-unit, and if the analog pixel data received by the i-th and j-th driving sub-units correspond to a same gray level, the i-th secondary switch is then turned on so that the i-th and j-th output terminal of the i-th and j-th driving sub-units toward an average voltage;

wherein signals outputted from the output buffer unit are coupled to the to-be-scanned pixels of the passive module.

9. The driving device as recited in claim 8, wherein the passive module comprises a liquid crystal display (LCD) panel.

10. The driving device as recited in claim 9, wherein the liquid crystal display panel is a thin film transistor (TFT) liquid crystal display panel.

11. The driving device as recited in claim 9, wherein the liquid crystal display panel is a liquid crystal on silicon (LCOS) panel.

12. The driving device as recited in claim 8, wherein j is equal to i+1 when the passive module is driven according to a line or frame inversion method.

13. The driving device as recited in claim 8, wherein j is equal to i+2 or i+6 when the passive module is driven according to a dot inversion method, a two dot line inversion method, or a column inversion method.

14. The driving device as recited in claim 8, wherein the i-th output buffer is an operational amplifier.

* * * * *